US007237707B1

(12) United States Patent
Wakelin et al.

(10) Patent No.: US 7,237,707 B1
(45) Date of Patent: Jul. 3, 2007

(54) HANDLE FOR TRIGGER OPERATED TOOL

(75) Inventors: Noel Roger Wakelin, Mount Maunganui (NZ); Dean Andrew Eldridge, Mt Maunganui (AU)

(73) Assignee: Dean Eldridge, Mt. Maunganui (NZ)

( * ) Notice: Subject to any disclaimer, the term of this patent is extended or adjusted under 35 U.S.C. 154(b) by 0 days.

(21) Appl. No.: 09/744,874

(22) PCT Filed: Jul. 28, 1999

(86) PCT No.: PCT/NZ99/00121

§ 371 (c)(1),
(2), (4) Date: Mar. 26, 2001

(87) PCT Pub. No.: WO00/06343

PCT Pub. Date: Feb. 10, 2000

(30) Foreign Application Priority Data

Jul. 28, 1998 (NZ) ..... 330859

(51) Int. Cl.
*B25C 1/00* (2006.01)

(52) U.S. Cl. ..... 227/147; 227/8; 227/120; 227/156; 173/170; 173/171; 173/36; 173/31

(58) Field of Classification Search ..... 173/170, 173/36, 31, 171; 227/8, 120, 147, 156
See application file for complete search history.

(56) References Cited

U.S. PATENT DOCUMENTS

| | | | | |
|---|---|---|---|---|
| 2,367,003 | A | 1/1945 | Carson | |
| 2,405,110 | A * | 8/1946 | Bullock | 173/141 |
| 2,440,852 | A * | 5/1948 | Elford | 408/99 |
| 3,949,817 | A * | 4/1976 | Rice | 173/170 |
| 3,985,188 | A * | 10/1976 | Steele | 173/170 |
| 4,147,220 | A * | 4/1979 | Swiderski et al. | 173/170 |
| 4,153,193 | A | 5/1979 | Urbanowicz | |
| 4,207,675 | A * | 6/1980 | Causey et al. | 30/296.1 |
| 4,284,223 | A * | 8/1981 | Salcido et al. | 227/5 |
| 4,339,065 | A * | 7/1982 | Haytayan | 227/8 |
| 4,359,822 | A * | 11/1982 | Kolodziejczyk | 173/170 |
| 4,736,804 | A * | 4/1988 | Geibel | 173/30 |
| 4,825,548 | A * | 5/1989 | Driggers | 173/162.2 |
| 5,135,388 | A * | 8/1992 | Pettit | 431/254 |
| 5,199,625 | A * | 4/1993 | Dewey et al. | 227/120 |
| 5,244,048 | A * | 9/1993 | Moorhead, Sr. | 173/141 |
| 5,295,620 | A | 3/1994 | Cousineau et al. | |
| 5,322,397 | A * | 6/1994 | Spear | 408/99 |
| 5,361,851 | A * | 11/1994 | Fox | 173/170 |
| 5,598,892 | A * | 2/1997 | Fox | 173/170 |
| 5,820,317 | A * | 10/1998 | Van Troba | 408/136 |
| 2003/0168491 | A1 * | 9/2003 | Goodwin | 227/147 |

FOREIGN PATENT DOCUMENTS

| | | |
|---|---|---|
| AU | 454083 | 10/1974 |

* cited by examiner

*Primary Examiner*—John Sipos
*Assistant Examiner*—Michelle Lopez
(74) *Attorney, Agent, or Firm*—Greer, Burns & Crain, Ltd

(57) ABSTRACT

A handle for attaching to a trigger operated hand tool, the handle including a shaft adapted so as to be attachable at one end thereof to the hand tool, a hand grip located at the other end of the shaft, and a trigger activator positioned near the hand grip capable of being operatively connected to the trigger associated with the hand tool.

9 Claims, 4 Drawing Sheets

HANDLE FOR TRIGGER OPERATED TOOL

TECHNICAL FIELD

The present invention relates to a handle for use with trigger operated hand tools.

BACKGROUND ART

In particular, the present invention relates to a handle for use with nail guns. However, this should not be seen as limiting as it is envisaged that the handle of the present invention may be applied to other trigger operated hand tools.

For ease of reference only, the trigger operated hand tool will now simply be referred to as a nail gun.

Currently, due to a persons arm only having a limited reach, use of a nail gun to secure an object to another object often requires an operator to bend down or alternatively use a ladder or such like to effect securement.

Examples of such activities may include the use of a nail gun to secure a floor to a joist, or a sheet of plasterboard such as GIBBOARD™ to purlins. As should be appreciated, the need to bend down or use ladders and such like, can unnecessarily increase the time taken to use a nail gun to secure an object. In addition, having to bend down so as to secure a floor to a joint can often lead to operators of nail guns suffering from back strain.

It is an object of the present invention to address the foregoing problems or at least to provide the public with a useful choice.

Further aspects and advantages of the present invention will become apparent from the ensuing description, which is given by way of example only.

DISCLOSURE OF INVENTION

According to one aspect of the present invention there is provided a handle for attaching to a trigger operated hand tool characterised in that the handle includes:

- a shaft adapted so as to be attachable at one end thereof to the hand tool,
- a hand grip located at the other end of the shaft,
- a trigger activator positioned near the hand grip capable of being operatively connected to the trigger associated with the hand tool.

It is envisaged that the trigger operated hand tool may be any one of a variety of hand tools without departing from the scope of the present invention.

In general, the trigger operated hand tool may be motorised.

The trigger of the hand tool will generally be in the form of a lever arrangement which is configured to allow for operation of the hand tool However, this should not be seen as limiting the scope of the present invention.

In preferred embodiments the trigger operated hand tool may be a nail gun.

For ease of reference only, the trigger operated hand tool will now simply be referred to as a nail gun.

It is envisaged that the length of the shaft may vary.

In general, the length of the shaft will be dependent on the reach of the average user. Typically, the length of the shaft may be substantially 50 cm–70 cm. However, this should not be seen as necessarily limiting the scope of the present invention.

It is envisaged that there may be a variety of different ways of adapting one end of the shaft so it can be attachable to a nail gun.

In preferred embodiments, the shaft may be adapted to include a clamp at one end thereof which is capable of holding a nail gun.

The hand grip may come in a variety of different forms without departing from the scope of the present invention.

In general, the hand grip may be angled with respect to the longitudinal axis of the shaft to allow for it to be easily gripped by a persons hand.

In preferred embodiment the handle may include a second hand grip positioned on the shaft at a point intermediate the two ends of the shaft.

In some further preferred embodiments, a second hand grip may also be provided, the second hand grip being adapted so as to be capable of having its position altered on the shaft of the handle.

In general, the second hand grip may include a collar adapted so as to either fix the handle in place, in a set position on the shaft, or alternatively allow the handle to move along the length of the shaft. This may usually be achieved, by using a collar which includes an open neck which can be closed or opened via tightening or loosening a bolt, or nut bolt combination. The effect of tightening or loosening the bolt, or nut and bolt combination, being to effectively increase or decrease the internal diameter of the collar.

It is envisaged the trigger activator may come in a variety of different forms without departing from the scope of the present invention.

In some embodiments, the trigger activator may be in the form of a button or switch.

In preferred embodiments the trigger activator may be in the form of a lever.

It is envisaged that the trigger activator may be operatively connected to the trigger of the nail gun in a variety of different ways without departing from the scope of the present invention.

In embodiments where the trigger activator may be in the form of a button or switch, the trigger activator may be electrically connected to the trigger mechanism of the hand tool. In an alternative aspect the trigger activator may be electrically connected to an electrical device configured to be capable of operating the trigger associated with the hand tool.

In preferred embodiments, the trigger activator may be a first lever operatively connected to the trigger associated with the nail gun via a cable. The cable being attached at one end thereof to the first lever such that pivoting of the first lever causes the relative length of the cable to increase or decrease to control activation of the trigger associated with the nail gun.

In general this may be achieved by the opposite end of the cable being connected to a second lever pivoted via the relative shortening or lengthening of the cable, to control activation of the trigger. However, it is envisaged other cable arrangements may be employed without departing from the scope of the present invention.

Thus, preferred embodiments of the present invention may have a number of advantages over the prior art which can include:

1. Allowing an operator to effectively increase the reach of their arm. As a result bending down or using ladders and such like may not be required when using a nail gun to secure an object to another object.

2. Decreasing the time taken to use a nail gun to secure an object to another object—for example, a floor board to a joist.
3. The handle is lightweight and can be cheaply manufactured.
4. The handle can easily be fitted to any nail gun.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
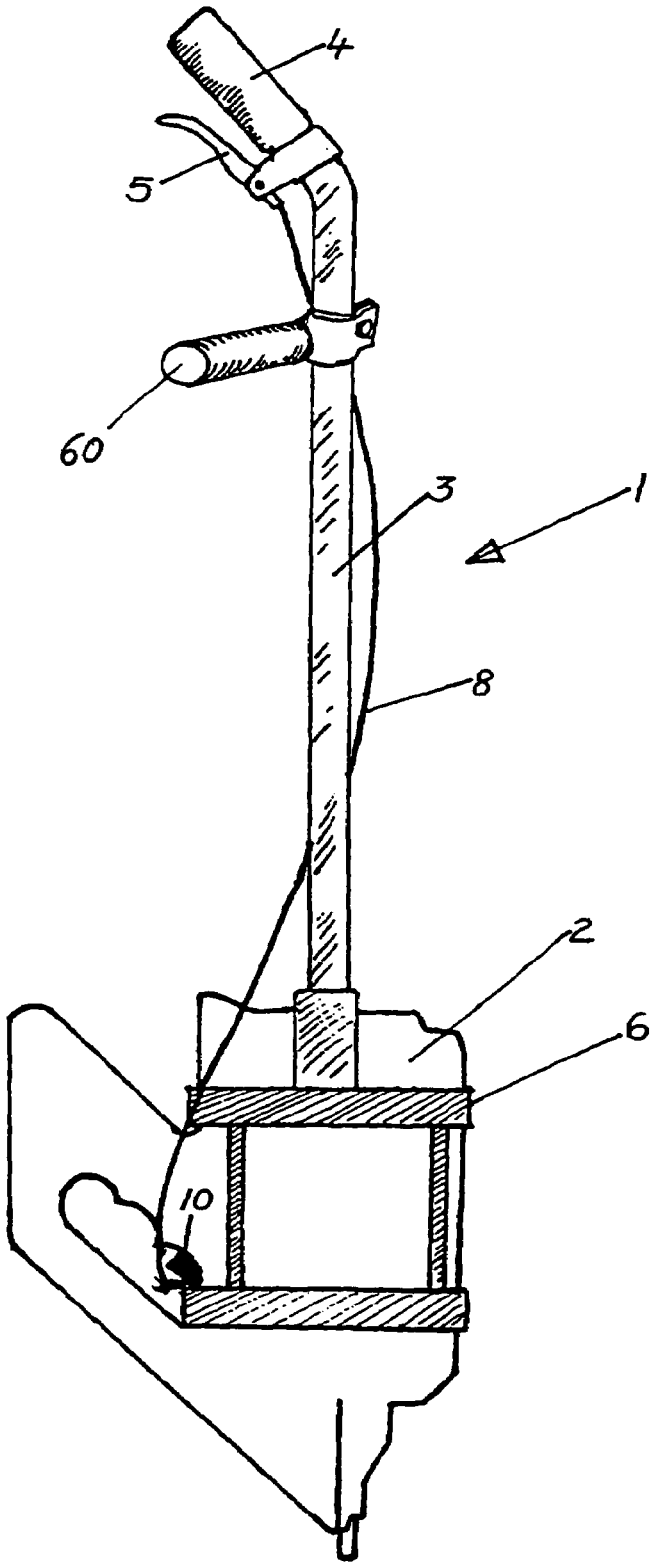
FIG. 1 is a side view of one preferred embodiment of the present invention.

With respect to the drawings there is provided a handle 1 which is attached to a PASLODE® cylindered powered nail gun 2. The handle 1 includes a shaft 3 which has a hand grip 4 located at one end thereof. Positioned substantially adjacent to the hand grip 4 is an activator lever 5. The handle 1 is provided with a second hand grip 60.

Figure 2:
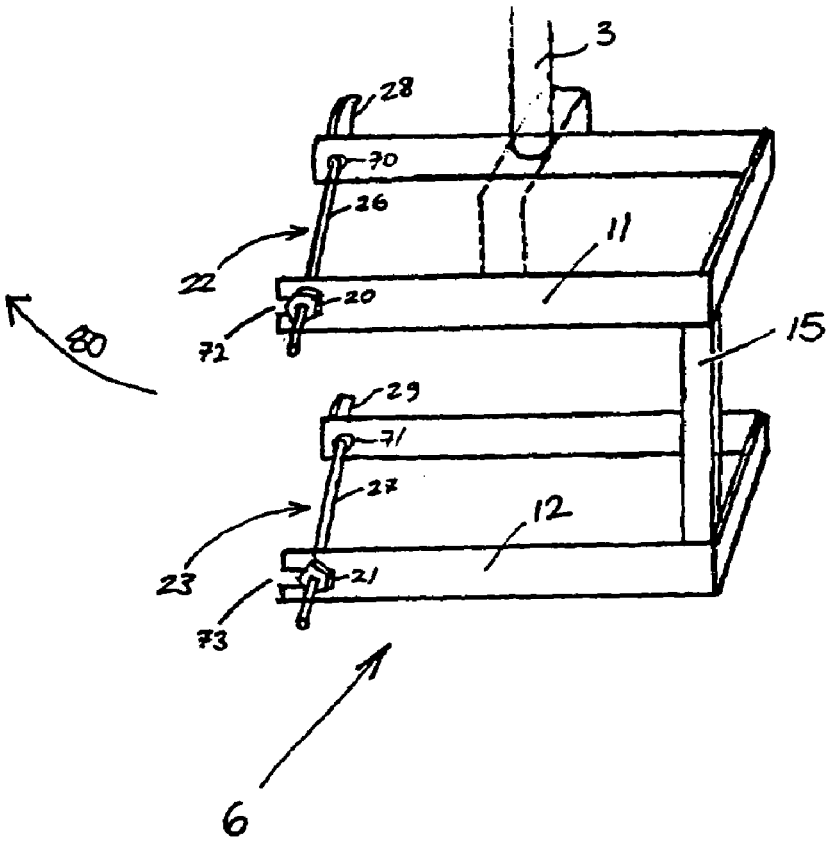
FIG. 2 is a partial view of the clamp showing a perspective view thereof.

The other end of the shaft 3 has a clamp 6 which attaches the handle 1 to the nail gun 2. The clamp 6 includes an upright element 15 and cross members 11 and 12 as shown clearly in FIG. 2. Cross members 11 and 12 are U-shaped when viewed from above and have an aperture 70, 71 near the end of one U-shaped arm 11, 12 and a slot 72, 73 near the other end of the U-shaped arm.

Figure 5:
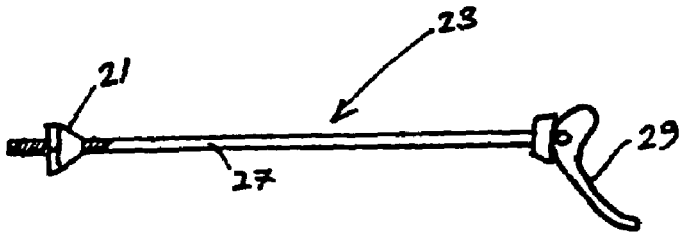
FIG. 5 is a plan view of a skewer shown in FIG. 2.

The nail gun 2 may be secured to or removed from the clamp 6 by means of skewers 22, 23. Skewers 22, 23 consist of a bolt element 26, 27 being threaded at one end so as to engage a nut 20, 21. The other end of the bolt element 26, 27 has or can include a lock 28, 29. This is shown most clearly in FIGS. 2 and 5. To remove nail gun 2 from the clamp 6 simply involves releasing the cam lock portion 28, 29 so that the nut ends of skewers 22 or 23 may be slid out of slots 72, 73 and moved outwardly in the general direction of arrow 80. To assist in this movement apertures 70, 71 should be a loose fit about bolt elements 26, 27.

To secure nail gun 2 to the clamp 6 is simply the reverse of the removal process. To ensure the nail gun is safely secured within the clamp 6 may however involve some adjustment of the nuts 20, 21 to ensure that the cam locks 28, 29 can operate effectively to clamp skewers 22, 23 and their respective slots 72, 73.

Figure 3:
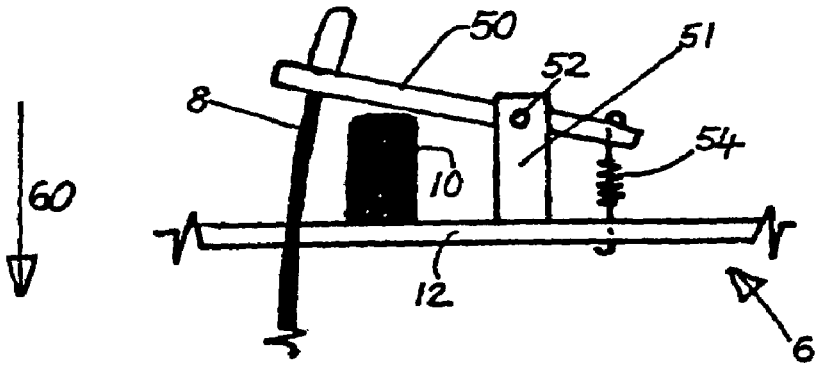
FIG. 3 is a diagrammatic top plan view illustrating how the trigger activator is operatively connected to the trigger of a nail gun.

The activator lever 5 is associated with a bowden cable 8 which has its other terminal end attached to a trigger lever 50 shown in FIG. 3. The trigger lever 50 is attached to the clamp 6 by means of two struts of which only the top strut 51 is shown. The trigger lever 50 is able to pivot about fulcrum 52 as the length of the bowden cable 8 is relatively increased or decreased via activation of lever 5.

Shortening of the bowden cable 8 in the direction indicated by arrow 60 causes the trigger lever 50 to depress trigger 10 of the nail gun 2. Once a nail has been fired return spring 54 helps return the trigger lever 50 to the position shown so as to release the trigger 10. Substantially, contemporaneously with this occurring the bowden cable 8 should effectively lengthen (once lever 5 is released by the operator) so that the trigger lever 50 can return to the position shown in FIG. 3.

Figure 4:
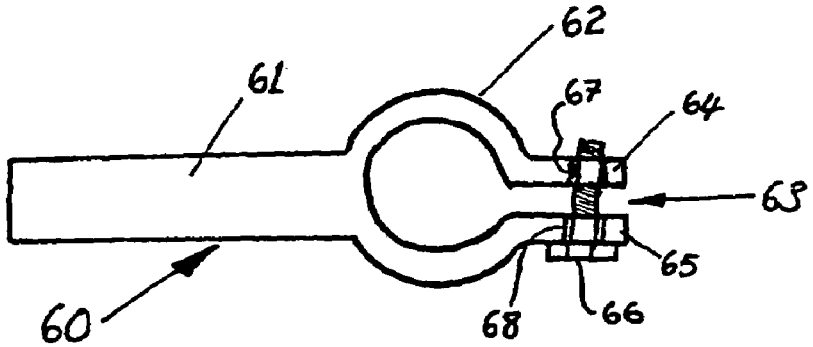
FIG. 4 is a diagrammatic top plan view of a second handle in accordance with a further aspect of the present invention.

With respect to FIG. 4 there is shown the second hand grip 60 having a handle portion 61 and a collar portion 62. The collar portion includes a neck 63 including two outwardly directed flanges 64, 65 having apertures 67, 68. The apertures are bridged via a bolt 66. The thread of the bolt 66 engages with a corresponding inner thread in aperture 67. Consequently, tightening the bolt (i.e. generally by turning in a clockwise direction) causes the two flanges of the neck 64, 65 to move towards one another so as to effectively decrease the internal diameter of the collar 62. Correspondingly, loosening the bolt 66 (i.e. generally by turning in a anti-clockwise direction) causes the two flanges of the neck to move away from one another effectively increasing the internal diameter of the collar 62. Thus, by this means the hand grip 60 can be slid along the length of shaft 3, to a desired position wherein the second handle grip 60 is fixed in place by tightening the bolt 66.

Figure 6:
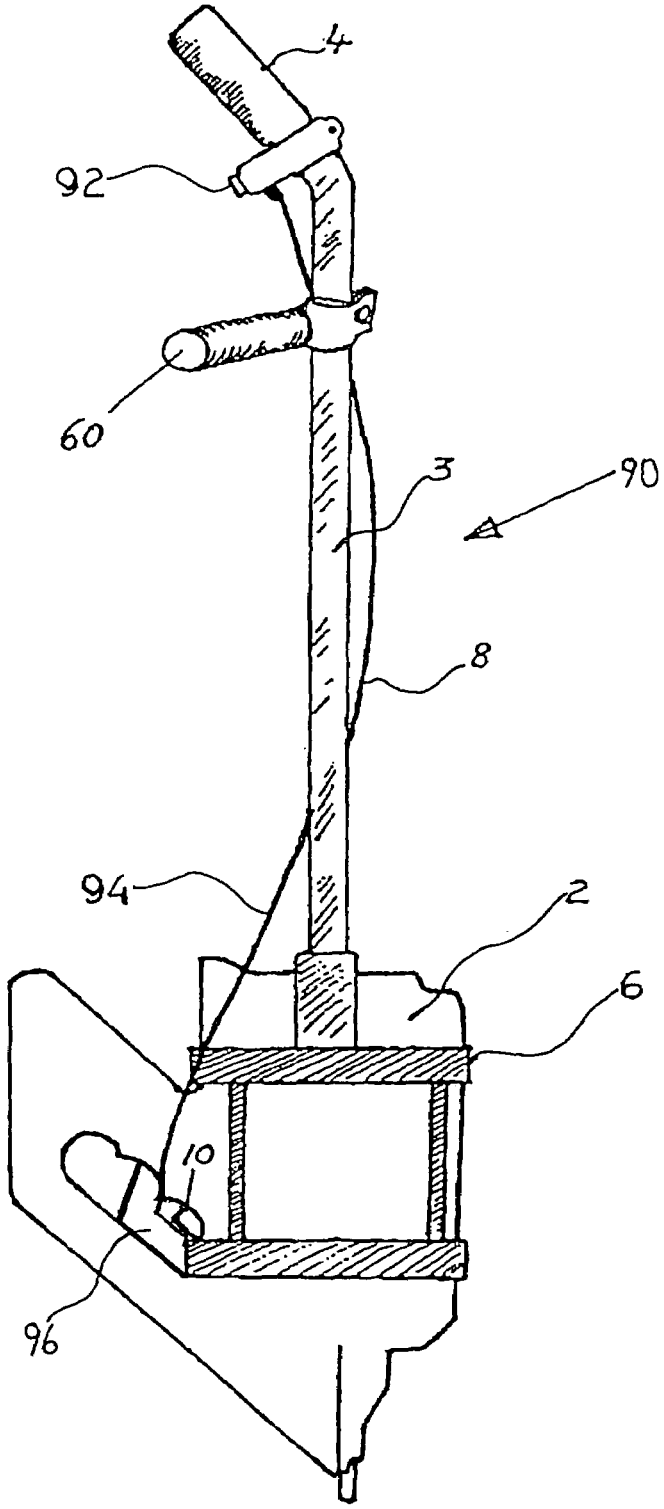
FIG. 6 is a side view of an alternate embodiment of the invention depicted in FIG. 1.

Referring now to FIG. 6, an alternate embodiment of the handle 1 is designated 90 and substitutes the mechanical trigger actuator 5 and the associated mechanical mechanism with an electrical activator including a button or switch 92 electrically connected via a wire 94 to the trigger mechanism 10 of the tool 2. The trigger activator button 92 is connected to an electrical device 96 configured to be capable of operating the trigger 10 associated with the hand tool 2.

Aspects of the present invention have been described by way of example only and it should be appreciated that modifications and additions may be made thereto without departing from the scope of the appended claims.

The invention claimed is:

1. A handle extension configured for retrofitting to a trigger operated fastener-driving hand tool, wherein the handle extension includes:

a shaft configured for attachment at one end thereof to the hand tool, wherein the shaft is configured for said attachment by way of at least one clamp arrangement having at least two sides which are spaced apart at one end for receiving at least a portion of the hand tool, and connected to each other at an opposite end, such that, in use, a longitudinal axis of said shaft extends in substantially the same direction as that in which the hand tool delivers fasteners;

a hand grip located at an opposite end of said shaft;

a trigger activator positioned near said hand grip and configured for being operatively connected to a trigger associated with the hand tool, wherein said trigger activator controls a trigger lever to operate the trigger associated with the hand tool;

said hand grip is angled with respect to a longitudinal axis of said shaft to allow the handle to be easily gripped by a person's hand and to have substantially the same position, in use, relative to the user, as a hand grip on the hand tool, such that normal operation of the hand tool is not compromised;

wherein the hand grip includes a second hand grip positioned on said shaft at a point intermediate to said two ends of said shaft, wherein said second hand grip extends radially from said shaft and is positionable about and along the longitudinal axis of said shaft, wherein said hand grip, said trigger activator and said second hand grip are sole user engagement points of said handle extension.

2. The handle as claimed in claim 1 wherein the trigger operated hand tool is motorized.

3. The handle as claimed in claim 1 wherein the trigger operated hand tool is a nail gun.

4. The handle as claimed in claim 1 wherein the length of the shaft is substantially 50 cm to 70 cm.

5. The handle as claimed in claim 1 wherein said second hand grip includes an integrally formed handle portion and a collar portion.

6. The handle extension as claimed in claim 1 wherein said two sides of said clamp arrangement are connected so as to be generally "U"-shaped.

7. The handle extension as claimed in claim 1 wherein said clamp arrangement includes at least one releasable fastener which can, in use, be released without the use of tools.

8. The handle extension as claimed in claim 1 wherein said clamp arrangement surrounds a portion of the tool.

9. A handle extension configured for retrofitting to a fastener driving hand tool, said extension comprising:

a shaft configured for attachment at one end thereof to the hand tool by way of at least one clamp arrangement having at least two sides which are spaced apart at one end for receiving a portion of the tool, and connected to one another at the other end, and wherein said two sides are connected so as to be generally "U"-shaped, and wherein said clamp arrangement includes at least one releasable fastener which is releasable without the use of tools, and wherein said clamp arrangement surrounds a portion of the tool, such that, in use, a longitudinal axis of said shaft extends in substantially the same direction as that in which the hand tool drives fasteners;

a hand grip located at an opposite end of said shaft;

a trigger activator positioned near said hand grip and configured for being operatively connected to a trigger associated with the hand tool, wherein said trigger actuator controls a trigger lever on the trigger to operate the trigger associated with the hand tool;

said hand grip is angled with respect to the longitudinal axis of said shaft to allow said hand grip to be easily gripped by a person's hand and to have substantially the same position, in use, relative to the user, as a hand grip on the hand tool, such that normal operation of the hand tool is not compromised; and wherein said hand grip includes a second hand grip positioned on said shaft at a point intermediate to said shaft ends, wherein said second hand grip extends radially from said shaft and is positionable about and along the longitudinal axis of said shaft, wherein said hand grip, said trigger activator and said second hand grip are the sole user engagement points of said handle extension.

* * * * *